United States Patent [19]

Wollam et al.

[11] 4,356,217

[45] Oct. 26, 1982

[54] PROCESS FOR PRODUCING STRIATED SURFACE COATINGS

[75] Inventors: Carl A. Wollam, Cortland; J. Lynn Gailey, Newton Falls; Alexander A. Chalmers, Warren, all of Ohio

[73] Assignee: Alcan Aluminum Corporation, Cleveland, Ohio

[21] Appl. No.: 226,706

[22] Filed: Jan. 21, 1981

[51] Int. Cl.[3] ..... B05D 5/00

[52] U.S. Cl. ..... 427/286; 118/411; 427/262; 427/280; 427/294; 427/295

[58] Field of Search ..... 427/286, 280, 345, 294, 427/356, 295, 357, 287, 358, 267, 262; 118/410, 411, 412, 415

[56] References Cited

U.S. PATENT DOCUMENTS

| | | | |
|---|---|---|---|
| 896,504 | 8/1908 | Adams | 118/412 |
| 1,830,662 | 11/1931 | Kail | 427/286 |
| 2,526,991 | 10/1950 | Biddle | 118/412 |
| 2,695,005 | 11/1954 | Lewin et al. | 118/412 |
| 2,916,012 | 12/1959 | Hergenrother | 118/315 |
| 3,106,480 | 10/1963 | Baker | 427/286 |
| 3,203,393 | 8/1965 | Colwill | 118/412 |
| 3,886,898 | 6/1975 | Colegrove et al. | 118/411 |

FOREIGN PATENT DOCUMENTS

| | | | |
|---|---|---|---|
| 283973 | 7/1965 | Australia | 427/286 |

*Primary Examiner*—Sadie L. Childs

*Attorney, Agent, or Firm*—Cooper, Dunham, Clark, Griffin & Moran

[57] ABSTRACT

Production of a longitudinally striated coating on a strip article by advancing the article past an open side of an otherwise-enclosed trench so that the article surface to be coated closes the open trench side, while delivering concurrent laminar flows of two different liquid coating materials to the trench at least at one locality spaced from the trench open side, to keep the trench completely filled and to deposit a layer of coating material on the moving article surface. Liquid circulation in the trench caused by the motion of the article surface so distributes the two coating materials along the trench that the applied coating layer is constituted of alternating longitudinal striations of the two materials. With delivery of concurrent flows of the two coating materials at each of plural localities spaced along the trench, positional and other variations of the striations can be achieved by varying the relative total flows delivered at different ones of these localities, for example to create a simulated wood-grain pattern.

13 Claims, 14 Drawing Figures

Fig. 5.
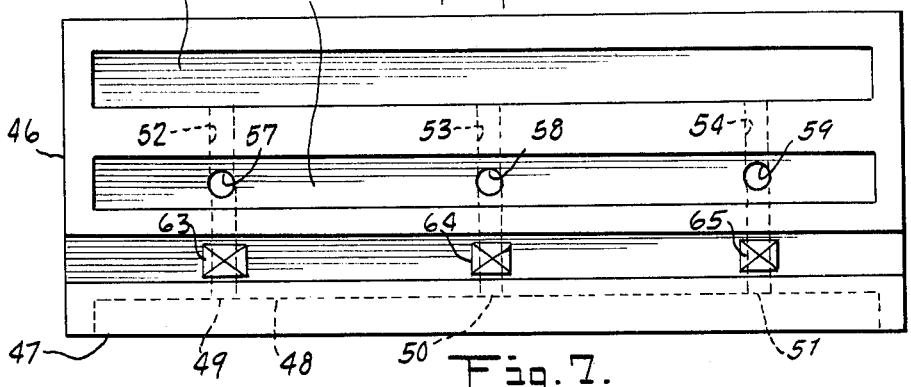
Fig. 7.
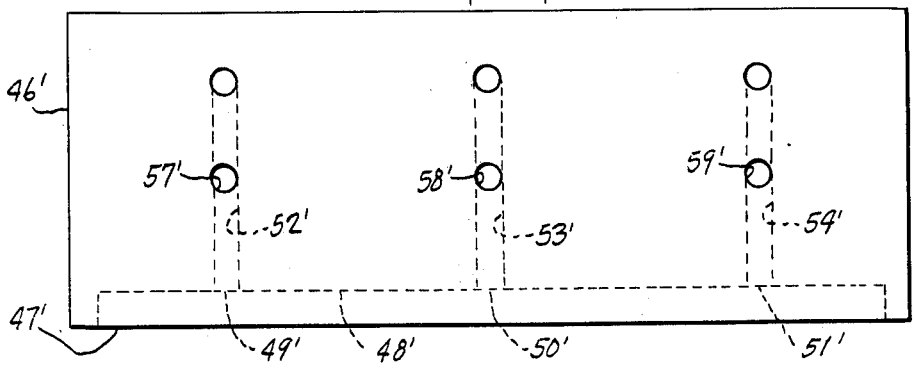
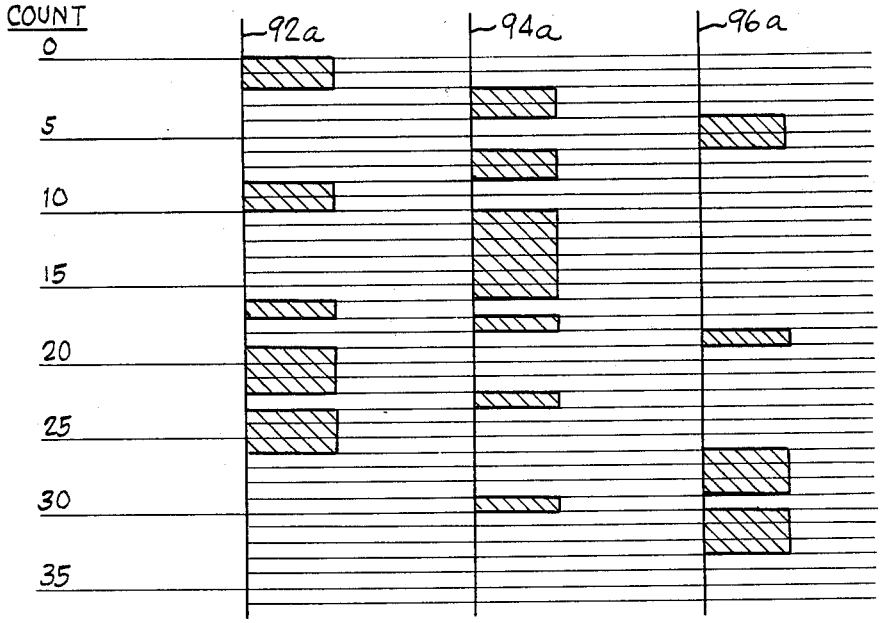
Fig. 10.

PROCESS FOR PRODUCING STRIATED SURFACE COATINGS

This invention relates to procedures and apparatus for producing striped or striated coatings of paint or the like on extended solid surfaces. In an important particular sense, it is directed to the production of longitudinally striated surface coatings on elongated strip articles, and especially to the provision of coatings wherein the lines or striations vary in thickness and/or lateral position along the length of the coated article, for example to create a pattern simulating the appearance of natural wood grain.

By way of specific illustration, detailed reference will be made herein to the coating of sheet material (e.g. aluminum) in greatly elongated strip form, as used for making siding panels for cladding exterior building walls, it being understood, however, that the invention in its broader aspects embraces the coating of other types of articles and surfaces as well.

In the production of siding panels from metal strip, at least one major surface of the strip is first given a protective and decorative coating of paint, and the strip is thereafter formed and cut into individual panels. The panels are commonly shaped to resemble wooden siding panels such as clapboards. Although the paint coating on the panels is usually of a single color, it is often desired to enhance the resemblance of the panels to wooden siding by imparting to their exposed surfaces a simulated wood grain appearance. Conventionally, this has been accomplished by applying, over a pre-established paint coating on a metal strip surface, a pattern of lines or striations of a second color; the grain pattern thus produced, however, is preferentially vulnerable to wear and weathering since it is an overlay, and it therefore tends to become impaired or even to disappear relatively early in the useful lifetime of the panel coating.

An additional disadvantage of conventional overlays is that they commonly provide an essentially invariant, repetitive pattern. For example, when the pattern is applied from a roll having a paint-bearing wood-grain design of elevated or recessed portions formed on its surface, the same pattern repeats at regular, relatively short intervals equal to the circumference of the roll, unlike the appearance of actual wood grain which varies randomly and nonrepetitively. In addition, with an overlay it is not easily possible to achieve the random or varying blending of colors that occurs along true wood-grain lines.

Various techniques are known for providing, in a single paint layer, bands or stripes of different shades or colors. These techniques, in general, involve delivery of paint of different colors to different locations along a trough or reservoir which extends transversely of the surface to be coated, and from which the paint is deposited onto the surface. Each stripe or band to be produced requires the provision of a separate paint delivery nozzle or spout in such systems, the location of the nozzle or spout determining the position of the band therby produced. Such arrangements are not convenient or suitable for the production of wood-grain patterns which should be constituted of numerous narrow lines or striations varying progressively in spacing and position as well as in width and in extent of blending of adjacent colors.

SUMMARY OF THE INVENTION

The present invention contemplates a process for producing a longitudinally striated coating on a major surface of an elongated strip article, comprising continuously advancing the article lengthwise past an open long side of an otherwise enclosed elongated trench extending transversely of the article with the surface to be coated disposed in facing proximate relation to the open trench side so as to constitute a moving wall closing that open side, while continuously delivering at least two liquid coating materials to the trench for providing concurrent laminar flows of the two materials along a common path, at least at one locality in a long side of the trench, and for maintaining the trench continuously entirely filled with the liquid coating materials, thereby to deposit a continuous coating layer on the article surface through the open trench side. In this operation, the two liquid coating materials are circulated within the trench by motion of the article surface in such manner as to be distributed in the coating layer in alternating longitudinal striations, whereby the desired striated pattern is produced.

Preferably and conveniently, the two liquid coating materials are delivered to the trench in concurrent laminar flows along a common path, at least at one locality in a long side of the trench spaced from the open side; thus, for example, the concurrent laminar flows can be established in a passage or conduit upstream of the trench and enter the trench through a common aperture (in the trench side wall) that constitutes the outlet end of the passage or conduit. In an alternative arrangement, the two liquid coating materials may be supplied to the trench through separate apertures angularly spaced about the long axis of the trench in such positions that the two coating materials come together as concurrent laminar flows just before reaching the open side of the trench.

The coating process of the invention is preferably used to apply a coating directly from the trench onto the surface of a strip article (e.g. metal strip to be formed into siding panels) which is ultimately to bear the coating. Alternatively, the coating can be applied from the trench onto a surface of an endless transfer belt, roll or the like from which the coating is subsequently transferred, while still wet, onto the surface which is ultimately to be coated. The term "elongated strip article" as used herein accordingly in its broadest sense also embraces an endless transfer belt, roll, or other structure providing a moving transfer surface on which a coating layer is deposited directly from the trench.

It is to be understood that the term "striations" is used herein to include lines, stripes, and bands, and other such forms without limitation as to any particular width thereof. Also, the term "liquid coating material" is used herein to embrace materials such as paints containing, in a liquid vehicle, a suspension of finely divided solid pigment. For example, to produce a coating layer wherein the striations of the two coating materials differ visibly from each other in appearance, these two coating materials may differ from each other in pigmentation, e.g. in the nature or proportion of pigment used, so that the produced striations differ in color or in shade. Ordinarily, the concurrent flows of the two coating materials introduced at any given common locality in the trench will include a major flow of one coating material and a minor flow of the other, and in such case the first-mentioned coating material will appear as the ground color of the produced coating layer, with stripes or striations of the second coating material distributed therein.

In the process of the invention, the concurrent laminar flows of the two coating materials, e.g. entering the trench through a common locality, flow laterally of the advancing strip (i.e. lengthwise of the trench) from the locality of their introduction to the trench. At the same time, the motion of the strip article surface past the open side of the trench, in a direction transverse to the long dimension of the trench, tends to produce a rotary circulation of the liquid within the trench about an axis generally parallel to the trench long dimension. It is at present believed that the combination of these two modes of motion of the introduced liquid, in a trench that is maintained entirely filled with liquid, creates a helical laminar flow of the two introduced coating materials about the axis of rotary circulation and extending along the length of the trench. Thus, under steady-state conditions, the introduced laminar flow of that one of the coating materials which represents a minor proportion of the total introduced flow at a given locality can be envisioned as assuming within the trench a standing helical pattern having turns which decrease both in width and in spacing along the trench in directions extending away from the locality of introduction. Where these turns come into contact with the advancing surface of the strip article, they produce longitudinal striations while the remainder of the strip article surface is coated with the coating material that constitutes the major proportion of the introduced flows.

Stated broadly, then, the process of the invention for producing a striated coating on an extended solid surface may be defined as comprising the steps of establishing and maintaining, in a confined chamber partially enclosed by a portion of the surface to be coated, concurrent, coaxial laminar helical flows of at least two liquid coating materials, the chamber being entirely filled with the liquid coating materials, while continuously effecting relative movement of the surface and the chamber, in a direction transverse to the axis of the helical flows, for depositing on the surface a coating layer having alternating striations of the two coating materials extending in the last-mentioned direction.

Referring further to the process of the invention as defined above for coating an elongated strip article, the relative widths of the striations of the two coating materials in the produced coating layer can be varied, e.g. progressively or repetitively along the length of the article, by varying the relative flows of the two coating materials delivered to the trench at the same locality. The striations of one of the coating materials may indeed be made discontinuous by completely interrupting the supply of that coating material at that locality or may be more greatly accentuated by increasing the pressure at which it is supplied.

As a further particular feature of the invention, the delivering step may comprise delivering concurrent laminar flows of at least two liquid coating materials to the trench along common paths at least at two localities, spaced apart along the length of the trench in a long side of the trench and spaced from the trench open side, such that adjacent longitudinal portions of the produced coating layer are respectively constituted of coating materials delivered at the aforementioned two localities, each of these portions comprising alternating striations of the two coating materials. The relative widths of the two longitudinal coating layer portions are dependent on the relative lengths (along the trench axis) of the trench portions respectively filled with the coating materials delivered at the two aforementioned localities; consequently, and further in accordance with the invention, the relative widths of these two coating layer portions can be varied by alternately shutting off and resuming (or otherwise varying over time) the relative total flows of coating materials respectively delivered at the two localities. This control feature can be extended to as many delivery localities as are employed, e.g. to three or even more localities.

The striations produced by the process of the invention, using for example a major flow of one coating material and a minor flow of a second, differently-pigmented coating material at each of plural coating localities along a trench, are suitable for simulating the appearance of wood grain, i.e. having spacing, individual width, and blending of the two colors appropriate for that purpose. The described control features, including the feature of controlling relative total flows delivered at different localities with or without the control of relative flows of the two coating materials delivered at each locality, readily enable the production of patterns with progressive positional, width and blending variations of the striations, along the length of a strip article, that very effectively simulate the appearance of a wood grain. Diverse other pattern effects, as may be desired, are also attainable through appropriate performance of these control operations.

The present process can be used to coat metal strip with a paint layer exhibiting a pattern of differently pigmented striations simulating wood grain. In this layer, the striations extend through the coating thickness, so that the pattern does not disappear or become impaired by wear or weathering but is as durable as the paint layer itself. The operations involved in producing this layer are relatively simple, convenient, and readily performable on a large commercial scale.

The invention further contemplates the provision of apparatus for performing the described process, such apparatus comprising, in a broad sense, structure for defining an elongated enclosed trench having an open side, means for advancing a strip article to be coated continuously past the trench with a major surface of the strip article closing the open trench side, and means for continuously delivering to the trench, at least at one locality in a long side of the trench spaced from the open side, concurrent laminar flows of at least two coating materials for maintaining the trench entirely filled therewith.

Further features and advantages of the invention will be apparent from the detailed description hereinbelow set forth, together with the accompanying drawings.

BRIEF DESCRIPTION OF THE DRAWINGS

FIG. 5 is a plan view of the structure of FIG. 4;

FIG. 7 is a plan view of the structure of FIG. 6;

FIG. 10 is a graphical representation of an example of a predetermined sequence of operations for controlling the supply of coating material at each of three locations along a trench, e.g. in apparatus as shown in FIG. 4 or FIG. 8, to produce a wood-grain-simulating pattern by the present process;

DETAILED DESCRIPTION

Figure 1:
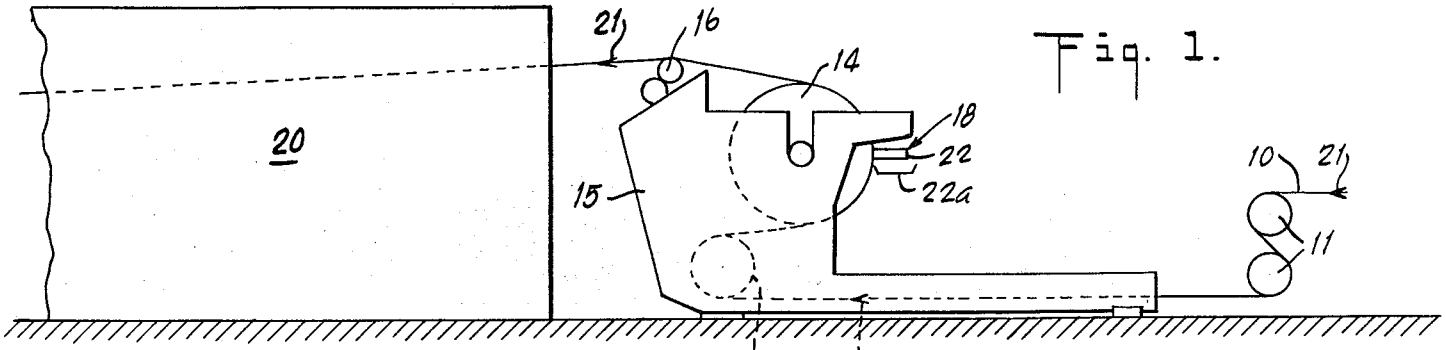
FIG. 1 is a diagrammatic side elevational view of a strip coating line arranged for performance of the process of the present invention and embodying the apparatus of the invention in a particular form.

The invention is illustrated in the drawings as embodied in procedures and apparatus for coating aluminum strip to establish a longitudinally striated paint layer on a major surface of the strip before the strip is formed and cut to produce siding panels. Such strip is typically an elongated, flat sheet aluminum article (having a length corresponding to the combined lengths of a substantial number of panels, and a width corresponding to the width of one panel), of a gauge suitable for siding panels, and is usually coiled for ease of handling.

Figure 2:
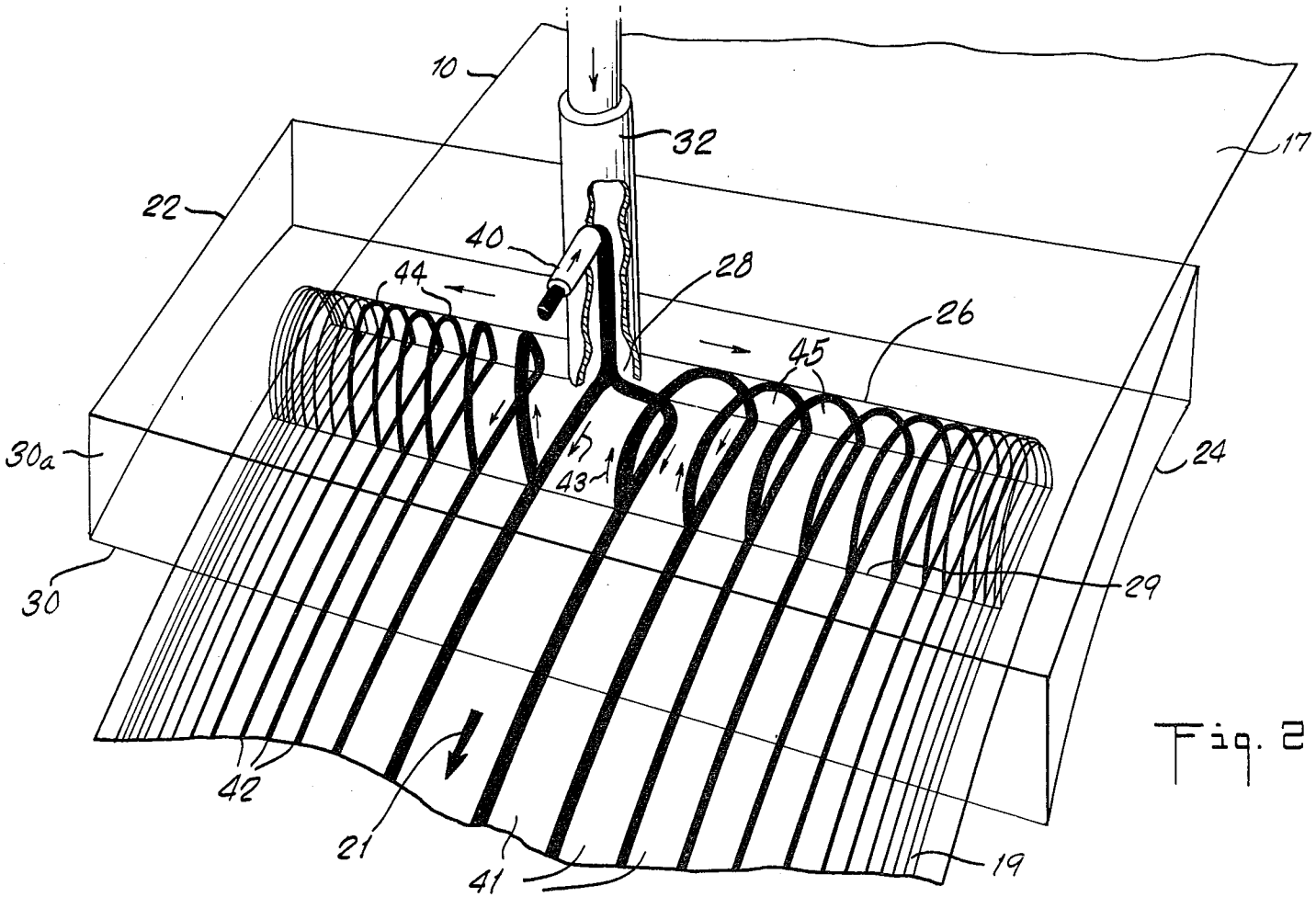
FIG. 2 is a diagrammatic perspective view illustrating the manner in which, as at present believed, the two supplied coating materials are distributed along the trench and deposited on the advancing strip article in the embodiment of the invention represented by FIG. 1.
Figure 3:
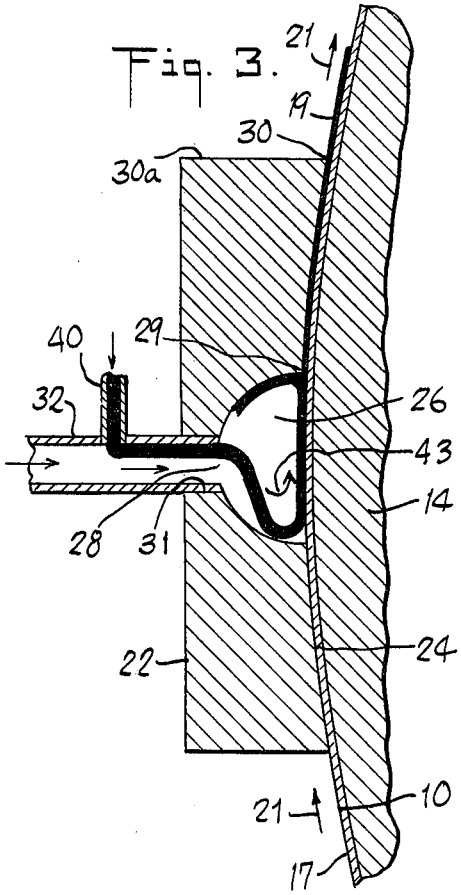
FIG. 3 is a schematic enlarged sectional elevational view of the paint-depositing portion of the coating line shown in FIG. 1, further illustrating the flow conditions in the trench.

In the coating line schematically shown in FIGS. 1-3, aluminum strip 10 to be coated is continuously advanced (by suitable and e.g. conventional strip-advancing means) longitudinally parallel to its long dimension from a coil (not shown) around rolls 11 and a guide roll 12, and thence over a back-up roll 14 (rotatably supported, with roll 12, in a frame 15) and a further roll 16. At a locality at which the strip is held against the back-up roll, paint is applied to the outwardly facing major surface 17 of the strip from a coating device 18, to establish on the strip surface 17 a continuous layer or coating 19 of the paint (FIG. 3). It will be understood that the major surface 17 of the strip 10 may bear a previously applied undercoat of paint, and the opposite surface of the strip may also be precoated. Beyond the roll 16, the strip is passed through an oven 20 to dry the coating, and thereafter coiled again, e.g. on a driven rewind reel (not shown) which, in such case, constitutes the means for advancing the strip through the coating line; within the oven, the advancing strip is in catenary suspension, and the weight of the suspended portion holds the strip against the back-up roll 14. The direction of strip advance through the coating line is indicated by arrows 21.

The coating device 18 (FIGS. 2 and 3) includes a metal block or plate 22 having a surface 24 curved concavely to conform to the surface of the back-up roll 14 and uniformly spaced from the roll surface to define therewith a gap through which the advancing strip 10 passes. As best seen in FIG. 2, the plate 22 (there shown in phantom outline) extends over the entire width of the strip at a locality, in the path of strip advance, at which the strip is held against the surface of the roll 14.

Formed in the plate 22 is an elongated trench 26 which opens outwardly through the surface 24 of the plate but is otherwise fully enclosed by the plate except for one or more paint-delivery apertures 28. This trench, in the embodiment shown in FIGS. 1-3, is an axially rectilinear, generally semicylindrical cavity having a smoothly arcuate side wall, flat closed ends, and a uniform cross-section throughout. It is oriented with its long dimension transverse to the direction of advance of the strip 10; very preferably, the long dimension of the trench is perpendicular to the direction of strip advance and parallel to the axis of rotation of the roll 14.

As will be understood from the foregoing description, the trench has an open long side (viz. the opening of the trench through plate surface 24) which extends, transversely of the path of strip advance, from end to end of the trench. The location and length of the open trench side determine the position and width, on the advancing strip, of the coating to be applied. That is to say, the open long side of the trench has a length less than or equal to the strip width, and is disposed for register with that portion of the width of the strip surface 17 which is to be coated. The back-up roll 14 supports the strip surface 17 in proximate facing relation to the open side of the trench as the strip passes the trench, so that the surface 17 constitutes a moving wall that closes the open trench side and enables the trench to be maintained filled with paint.

The described arrangement of trench and strip results in deposit of paint from the trench onto the strip surface 17 over the full width of the portion of the surface 17 that coincides with the open side of the trench, i.e. when the trench is filled with liquid paint delivered through the aperture 28. The deposited paint is carried out of the trench as a coating on the advancing strip surface, past the outlet edge 29 of the open side of the trench and through the gap between the plate surface 24 and the roll 14 beyond the trench. The edge 29, shown as a sharp discontinuity between the upper side wall of the trench and the plate surface 24, extends across the width of the deposited paint coating on the strip surface 17 and, together with the surface 17, defines a metering orifice that determines the thickness of paint coating carried on the strip away from the trench; as will be understood, the spacing between the surface of roll 14 and the plate surface 24 is selected to provide a gap equal to the thickness of the strip 10 plus a desired wet thickness of paint coating on the surface 17. The coated strip surface emerges from beneath the plate past a transverse outlet edge 30 of the plate, which is a sharp discontinuity between the surface 24 and a flat end surface **30*a* of the plate. Preferably, the plane of end surface 30*a* forms an angle (opening upwardly toward the direction of strip advance) of at least about 90° with the plane tangent to the strip surface 17 at edge 30, for assured avoidance of pick-up of paint from the emerging strip onto the surface 30***a;* in FIG. 3, this angle is greater than 90°.

As shown in FIG. 1, the plate 22 is preferably so disposed that its trench, facing back-up roll 14, lies substantially in a horizontal plane containing the axis of rotation of the back-up roll, and the coating line is so arranged that the strip is held against the back-up roll at this locality, which is thus the locality at which paint is applied to the strip. It will be understood that in continuous coating of strip, successive lengths of strip are usually joined together (spliced) endwise at a transverse seam which is thicker than the strip gauge; when this seam passes between the plate 22 and roll 14, the plate must be temporarily moved away from the roll sufficiently to accommodate the thickness of the seam. If, for example, the plate 22 were located above the roll 14, so that the trench opened downwardly, such movement of the plate away from the roll would cause the paint then contained in the trench to be dumped on the passing strip surface, resulting in unsatisfactory coating of the strip for many feet beyond the seam. The disposition of the plate shown in FIG. 1 largely obviates this problem because paint in the trench, when released by movement of the plate away from the strip, falls into a drip pan 22*a* rather than onto the strip surface, and therefore does not interfere with resumed application of a satisfactory coating layer upon return of the plate to operative position. In consequence, production of unacceptably coated scrap strip is advantageously minimized.

The delivery aperture 28 is located in the side wall of the trench and spaced from the open side of the trench; in the device of FIGS. 1–3, the aperture 28 opens into the trench at a location directly opposite the trench open side and equidistant from the ends of the trench. A cylindrical bore 31 extends outwardly from the aperture 28 through the plate 22 and receives the outlet end of a delivery tube 32. To this tube, a first liquid coating material (viz. paint of a first shade or color) is supplied from a container (not shown) under pressure. A second liquid coating material (paint of a second shade or color, visually distinguishable from the aforementioned first shade or color) is also supplied to the tube, through a T-junction 40 located somewhat above the aperture 28, from a container (not shown), again under pressure. The pressure, in each case, may either be hydrostatic pressure or be provided by a suitable pump. Valve means (not shown in FIGS. 1–3) are employed for controlling the paint supply to the trench; specific arrangements of such valve means are described below with reference to FIGS. 4–7. The T-junction 40 is shown as oriented so that the center of its opening into the tube 32 is on the side of the tube toward the outlet edge 29 of the trench (although it could equally well be located in a diametrically opposite position, i.e. on the side of the tube toward the inlet edge of the trench) and lies in a vertical plane containing the axis of tube 32 and perpendicular to the long dimension (i.e. the horizontal longitudinal axis) of the trench. Thus, paint entering the tube 32 from the T-junction 40 flows along the last-mentioned side of the tube into the trench.

The tube 32 and T-junction 40, together with associated paint containers and pumps and valves (if used), cooperatively constitute means for delivering to the trench 26, along a common path extending through the aperture 28, concurrent laminar flows of the aforementioned two coating materials. It will be appreciated that the requisite laminar flow condition (in which the two paint colors travel smoothly side by side in a common conduit, without turbulence and at least substantially without mixing or blending even though they are not separated) can readily be achieved and maintained by appropriate selection of flow rates, which are determined by such factors as supply pressures, for given conduit or passage sizes. In the device of FIGS. 1–3, the concurrent laminar flows of the two paint colors enter the trench, at aperture 28, with a common flow direction normal to the strip surface 17 passing the open side of the trench.

In the practice of the present process with the coating line of FIGS. 1–3, the strip 10 to be coated is advanced continuously along the path described above, around the back-up roll 14 and past the coating device 16, while the trench 26 is maintained continuously entirely filled with the two colors of paint by continuous delivery of the two colors to the trench under pressure in concurrent laminar flows along a common path through the aperture 28, thereby to deposit a continuous coating layer 19 of the paint on the strip surface 17. Since the trench is initially entirely filled with paint, this filled condition of the trench is maintained by delivering to the trench a total flow of paint (the term "flow" being herein defined as volume per unit time) equal to the volume of paint per unit time removed from the trench on the strip surface. Typically, the concurrent flows comprise a major proportion or flow of the first shade or color (shown in FIGS. 2 and 3 as a light color) and a minor proportion or flow of the second shade or color (shown in FIGS. 2 and 3 as a dark color). Conveniently, both flows are supplied at the same pressure, and the quantitative difference between the two flows is determined by the difference in size of the orifices through which they are respectively delivered; i.e. the diameter of tube 32 is greater than that of T-junction 40. As stated, the flow rates (velocities) are selected to ensure maintenance of laminar, nonturbulent flow conditions so that the two colors enter the trench as discrete, usually substantially nonblended flows (although there may be some degree of blending, especially if the second-color flow and first-color flow are conjoined in a common conduit for any considerable distance upstream of the trench); in general, the requisite laminar flow conditions will obtain so long as the flow rates are kept below maxima that are readily determinable, as will be apparent to those skilled in the art.

With the trench maintained entirely filled, and with maintained delivery of paint thereto in concurrent laminar flows, the coating layer 19 of paint on the strip surface 17 emerging from the outlet edge 30 of the plate 22 is characterized by a pattern of more or less clearly defined alternating longitudinal striations of the two colors of paint. Some blending of colors occurs as the coating layer is laid down on the strip surface, so that the striations may exhibit intermediate or mixed shades, particularly under the conditions of operation described below with reference to FIGS. 4–10, but in the simple case represented by FIG. 2, the striations are typically quite sharp, with relatively little blending. To produce the pattern illustrated in FIG. 2, a single major flow of light-colored paint and a single minor flow of dark-colored paint are delivered to the trench through a single common aperture 28. As there shown, the pattern in such case is constituted of wide bands 41 of the light color and narrow bands 42 of the dark color; the narrow bands decrease progressively both in thickness and in spacing toward both sides of the strip from the locality corresponding to the position of the delivery aperture 28 along the length of the trench. A substantial plurality of striations of each color are thus produced by the paint delivered through a single aperture. Both dark and light striations extend through the thickness of the paint layer, so that the pattern does not tend to disappear upon weathering (i.e. when the strip is formed and cut into panels for installation on exterior building walls with the thuscoated surfaces of the panels exposed) as would occur, for example, if the dark striations were simply overprinted on an underlying layer of the light color.

The distribution of the two colors of paint within the trench that produces the described striations is caused by liquid circulation within the trench resulting from movement of the strip surfaces past the open side of the trench. More particularly, it is at present believed that the pattern is created by a combined effect of two modes of fluid motion within the trench. The paint flows entering the trench concurrently through the aperture 28 tend to move from the aperture toward the opposite ends of the trench; at the same time, the movement of the strip surface 17 (which is in contact with the liquid in the trench, at the open side thereof) effects a rotary circulation of the paint in the trench, in the direction of arrows 43, about an axis parallel to the long dimension of the trench. The resultant of these two modes of fluid motion, as at present believed, is a concurrent helical laminar flow of the two colors of paint around the side walls of the trench (including the strip surface 17) about the lastmentioned axis, along the length of the trench in both directions away from the aperture 28. That is to say, it is believed that the laminar flow condition is maintained within the trench although the flow direction becomes helical rather than linear. This flow pattern is shown in FIG. 2, wherein the plate 22 is represented only by phantom lines to facilitate illustration of the presumed helical flow in the trench. As each turn of the dark-colored helix 44 impinges on the strip surface 17, some of the dark color is deposited on the strip surface, producing a dark striation in the coating layer. Light striations are similarly produced in the coating layer from the light-colored helix 45.

In steady-state operations, viz. with strip velocity, input paint flows and other conditions maintained constant, the coating pressure is substantially invariant, and can be reproduced by duplication of the same conditions in another run. The appearance of the specific pattern obtained in a given instance is dependent on a variety of factors. In particular, the width of the individual striations of, for example, the dark color in the pattern shown in FIG. 2 can be increased or decreased by increasing or decreasing the flow (volume per unit time) of the dark color paint relative to the flow of the light color paint.

The number of lines or striations of each color in the pattern produced by paint delivered to the trench through a single aperture is dependent on the cross-sectional dimension of the trench and on the wet thickness of the coating layer withdrawn from the trench on the strip surface. Coating thickness is, of course, governed by the distance between the outlet edge 29 of the trench and the strip surface 17. The number of lines or striations increases with increasing cross-sectional dimension of the trench, and also increases with decreasing wet thickness of the coating layer. It is believed that this result is attributable to the effect of trench cross section and coating thickness on the component of liquid flow velocity in the trench in directions from the aperture 28 toward the ends of the trench. That component of flow velocity decreases (for a given total input flow of paint to the trench) with increasing trench cross section and also with decreasing wet coating thickness, which reduces the volume of coating material consumed per unit time; and the number of turns in the assumed helical flow pattern within the trench increases with decrease of flow rate toward the ends of the trench.

Increase of the width of the trench (and consequently of the open side thereof) without change in the height of the trench enhances the exposure of coating material in the trench to the moving strip surface, resulting in improved "pumping" (rotary circulation) action in the trench. The width of the striations of the two colors is also affected by the relative viscosities of the two paints. Increase in strip speed past the trench requires an increase in the pressure at which the two coatings are supplied, to provide the necessary increase in coating volume.

Still another factor that affects the appearance of the produced coating is the length (in the direction of strip advance) of the portion of the plate surface 24 which extends from the outlet edge 29 of the trench to the outlet edge 30 of the plate. This surface or land, as stated, provides a uniform gap (between the strip surface 17 and the plate surface 24) of extended length in the direction of strip advance, through which the wet coating layer passes immediately beyond the trench, affording desired smoothness and uniformity of thickness of the coating. It is found that the length of this surface portion beyond the trench affects the rapidity with which the produced striated coating pattern changes with variation of conditions within the trench such as those described with reference to FIGS. 4–10 below; specifically, the pattern changes more rapidly in response to changes in trench conditions with decrease in length of the portion of surface 24 between the trench edge 29 and the plate edge 30. In addition, the length of this surface portion affects the extent of blending of the two applied colors in the striated patterns: the greater the length, the greater the degree of blending.

The orientation of the long dimension of the trench relative to the direction of strip movement is yet another variable that affects the component of liquid flow toward the ends of the trench, the resultant assumed helical flow pattern, and the width of the produced striations. It is, however, at present greatly preferred to orient the trench so that its long dimension is, as shown, perpendicular to the direction of strip travel rather than at some other angle thereto.

A still further variable affecting the produced pattern is the location of the point of entry of the second color paint into the tube 32 through the T-junction 40. The distance of that point of entry from the aperture 28 affects the degree of blending of the two supplied colors; as that distance increases, extending the length of the common path of the two flows upstream of the aperture 28, the extent of blending increases. Also significant is the angular orientation of the point of entry: referring to FIGS. 1–3, if the tube 32 were rotated about its axis so as to displace the T-junction 90° from the position shown, i.e. to move the locality of introduction of the second color paint to the side of the tube 32 nearest one end of the trench, then the striations of the second color paint would be produced only in that portion of the coating layer corresponding positionally to that half of the trench extending from the aperture 28 to the last-mentioned trench end. Angular displacement of the T-junction 180° from the position shown (i.e. location of the T-junction on the side of the tube facing away from the trench outlet edge 29), however, again produces a striated pattern extending over the full width of the applied coating. If the tube and T-junction are so mounted as to permit rotation about the axis of the tube during the course of a coating operation, positional variation in the second color striations across the width of the produced coating layer can be achieved in this way.

Two embodiments of the invention capable of producing a coating with a wood-grain-simulating pattern of striations are illustrated schematically in FIGS. 4–5 and 6–7. In these embodiments, concurrent laminar flows of two liquid coating materials (paints of different shades of colors) are delivered to the trench of the coating device along common paths at each of three localities spaced apart along the length of the trench.

Figure 4:
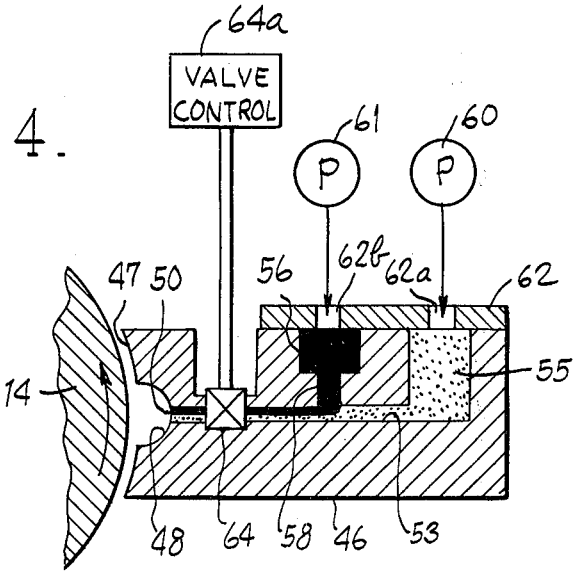
FIG. 4 is a schematic sectional elevational view of one form of the trench-defining structure and associated paint-supply arrangement of the apparatus of the invention.

In the embodiment of FIGS. 4 and 5, the coating device 18 includes a plate 46 generally similar to the plate 22 of FIGS. 1–3 in having an arcuate surface 47 facing the back-up roll 14 and in having an elongated and open-sided trench 48 formed therein, oriented with its long dimension extending transversely of the path of strip advance around the roll 14; again, as is preferred for application of a striated coating, the closed side wall of the trench is curved about the long axis of the trench. Paint is supplied to the trench through three apertures respectively designated 49, 50, and 51, all opening into the trench directly opposite the open side thereof. Aperture 49 is spaced from one end of the trench by a distance equal to one-sixth the trench length and aperture 51 is similarly spaced from the other end of the trench by a like distance, while aperture 50 is located halfway between the trench ends; thus, considering the trench length as divided into thirds, each aperture is centered in one of these thirds.

The three apertures 49, 50 and 51 respectively constitute the outlet ends of three paint supply passages 52, 53 and 54 formed in the plate 46, and all communicating with a first common paint reservoir trough 55 which extends lengthwise of the plate. A second common paint reservoir trough 56, parallel to the trough 55, communicates with the passages 52, 53, and 54 through transverse passages 57, 58, and 59 (also formed in the plate) at localities intermediate the trough 55 and the apertures 49, 50 and 51. It will be understood that, with respect to its associated aperture, each passage 52, 53 or 54 corresponds positionally and functionally to the tube 32 of FIGS. 2–3, and each transverse passage 57, 58 or 59 corresponds positionally and functionally to the T-junction 40 of FIGS. 2 and 3. Paint of a first color is supplied to the reservoir trough 55 under pressure by means represented as a pump 60, and paint of a second (e.g. darker) color is supplied to the trough 56 under pressure by means represented as a pump 61; alternatively, the paint could be supplied directly from containers by gravity feed, utilizing hydrostatic pressure to provide the requisite pressure conditions. The troughs 55 and 56, which open through the top face of the plate 46, are closed by a cover 62 having apertures **62*a* and 62*b*** for admission of the paint to the troughs.

Three electrically controlled valves 63, 64, and 65 are mounted in the plate 46 to open and close the three passages 52, 53, and 54, respectively, at localities intermediate the transverse passages 57, 58, and 59 and the apertures 49, 50, and 51. Each of these valves is individually operable (by control means represented at **64*a*) to interrupt or permit flow of paint of both colors through its associated passages 52, 53 or 54**.

As in the case of the single tube 32 and T-junction 40 in FIGS. 2 and 3, each passage 52, 53 or 54 delivers concurrent laminar flows of the two colors of paint through its associated aperture 49, 50 or 51 to the trench. Preferably, the respective diameters of the main passages (52, 53, 54) and the transverse passages (57, 58, 59) are such that with paint supplied to the two troughs 55 and 56 under equal pressure, a major flow of the first color of paint (from trough 55) and a minor flow of the second color of paint (from trough 56) are delivered to the trench through each aperture. Under this condition of equal-pressure supply to the two troughs, when the concurrent flow through one of the passages 52, 53 and 54 is interrupted by closing of the valve in that pressure, the two flows upstream of the valve stand unmixed in the passage, so that upon reopening of the valve, delivery of the concurrent laminar flows is immediately resumed. Alternatively, the relative flows of paints can be varied by operation of suitable means (not shown) for relatively varying the pressures at which the paints are supplied.

Figure 6:
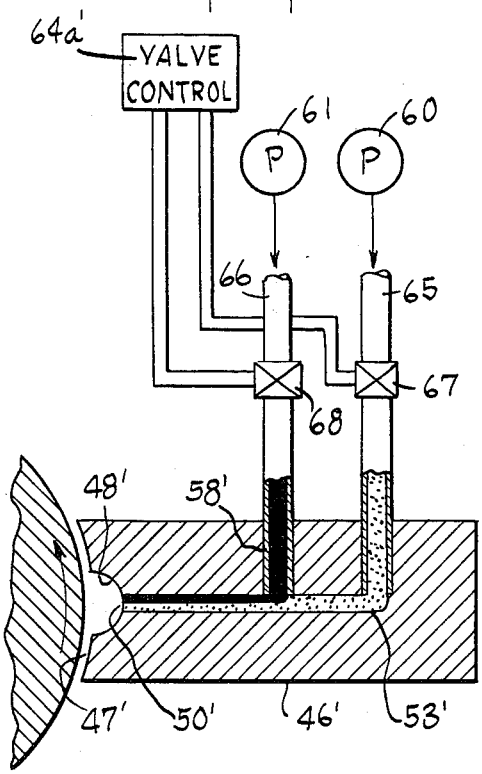
FIG. 6 is a view, similar to FIG. 4, of another form of the trench-defining structure and paint supply arrangement features of the apparatus of the invention.

The modified embodiment shown schematically in FIGS. 6 and 7 differs from that of FIGS. 4 and 5 in providing individual control of the supply of each color of paint to each aperture of the trench. The plate 46′ of the coating device of FIGS. 6 and 7 has an arcuate surface 47′ facing the back-up roll 14 and an elongated trench 48′ opening toward the roll 14, with apertures 49′, 50′ and 51′ spaced apart along the length of the trench at locations directly opposite the open side of the trench, passages 52′, 53′ and 54′ respectively opening into the trench through the three apertures, and transverse passages 57′, 58′ and 59′ respectively opening into the passages 52′, 53′ and 54′ upstream of the apertures; the arrangement of these features is essentially the same as that of the correspondingly numbered features in the embodiment of FIGS. 4 and 5. Instead of communicating with a common reservoir trough 55 or 56 as in FIGS. 4 and 5, however, each passage 52′, 53′ and 54′ is individually connected to the first-color paint supply (represented by pump 60) by a separate conduit (e.g. conduit 65, for passage 53′, shown in FIG. 6), and each transverse passage 57′, 58′ and 59′ is likewise individually connected to the second-color paint supply (represented by pump 61) by a separate conduit (e.g. conduit 66, for passage 58′, in FIG. 6); and instead of a single electrically controlled valve at each aperture for shutting off flow of both colors of paint together, separate electrically controlled valves (67 and 68, in FIG. 6) are respectively provided for the two conduits which respectively deliver the two colors of paint to the passages associated with each aperture, these valves being operated by a control represented at **64*a′*. Thus, for example, the flow of the second-color paint to the trench through aperture 50′ can be shut off by operation of valve 68 without shutting off the supply of first-color paint to aperture 50′ and without shutting off the supply of second-color paint to either of the other apertures. Alternatively, the two valves associated with each aperture can be operated together to effect simultaneous interruption and resumption of flow of both colors through the aperture, as in the case of the embodiment of FIGS. 4 and 5**.

Performance of the present process with coating devices as schematically shown in FIGS. 4–7, to apply to metal strip a striated paint coating having a wood-grain-simulating pattern, will be described with reference to the specific embodiment of such apparatus illustrated in FIGS. 8 and 9.

Figure 8:
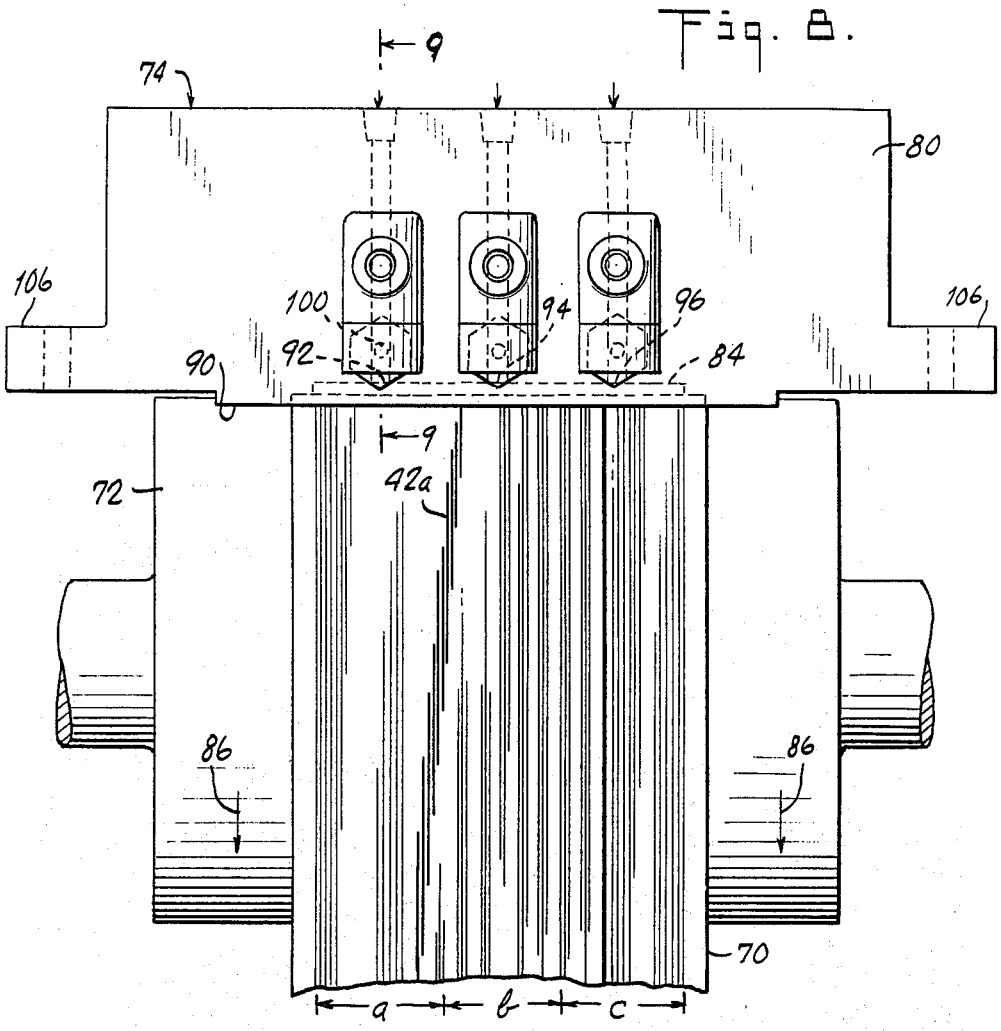
FIG. 8 is a simplified top plan view of an embodiment of the apparatus of the invention, adapted for performance of the present process to coat metal strip with a layer of paint having a simulated wood grain pattern.
Figure 9:
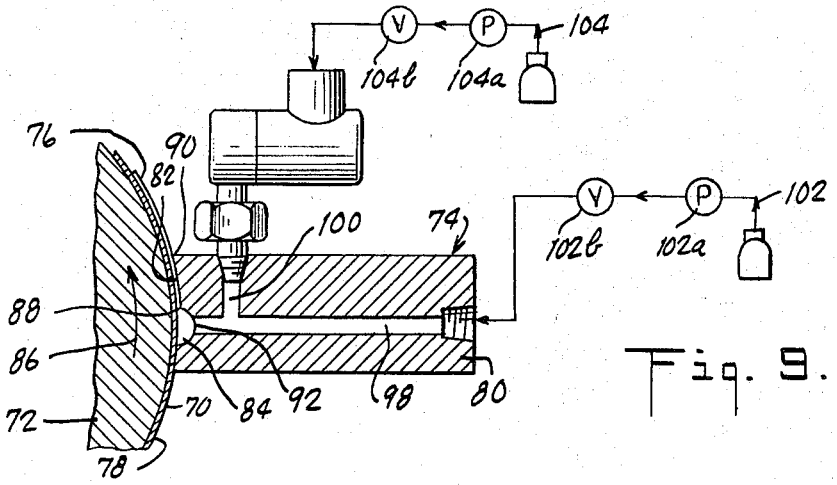
FIG. 9 is a fragmentary sectional view taken along the line 9—9 of FIG. 8.

Specifically, in the apparatus of FIGS. 8 and 9, an aluminum strip 70 to be coated is advanced longitudinally by means including a back-up roll 72 over which the strip passes. A coating device 74 applies a coating layer 76 of paint to a major surface 78 of the strip at a locality at which the strip is held against the roll 72 with the surface 78 exposed and facing outwardly. This device includes a block or plate 80 mounted immediately adjacent the roll 72 at that locality and having a surface 82 curved concavely to conform to the surface of the roll and facing the roll in a position to define, with the roll surface, an arcuate gap through which the strip passes while being coated. A horizontally elongated, axially rectilinar trench 84 for confining a body of liquid coating material (paint) is formed in the end portion of the plate 80, and opens through the plate surface 82 toward the strip surface 78; thus the trench, which is oriented with its long dimension parallel to the axis of roll 72 and perpendicular to the direction of strip advance (represented by arrows 86), has an open long side, but is otherwise enclosed by a side wall (preferably generally semicylindrical) and flat end walls. The back-up roll 72 is positioned to maintain the strip surface 78 in proximate facing relation to the open long side of the trench so that the surface 78 constitutes a moving wall effectively closing the open trench side.

The features of the apparatus of FIGS. 8 and 9 thus far described correspond generally to the back-up roll, plate and trench shown in FIGS. 1–3. As in the case of the embodiments of FIGS. 1–3, during a coating operation, the strip 70 is continuously advanced over the back-up roll while the trench 76 is maintained continuously entirely filled with paint, which deposits on the passing strip surface 78 as a continuous wet coating layer having a thickness determined by the spacing between the outlet side edge 88 of the trench and the strip surface 78. Also as in FIGS. 1–3, beyond the trench the coating layer passes through a uniform gap, defined by a portion of the plate surface 82, of extended length in the direction of strip travel; the provision of this gap aids in assuring the smoothness and uniformity of thickness of the coating emerging from beneath the sharp outlet edge 90 of the plate 80.

In the device of FIGS. 8 and 9, as in the structures of FIGS. 4–7, three paint-delivery apertures (respectively designated 92, 94 and 96) are formed in the side wall of the trench 84, at localities spaced apart along the length of the trench and spaced from (viz. directly opposite) the open long side of the trench. The central aperture 94 is positioned halfway between the ends of the trench; the apertures 92 and 96 are respectively positioned between the aperture 94 and the opposite ends of the trench, at distances (from aperture 94) each equal to one third of the total length of the trench, so that the three apertures are respectively centered in adjacent thirds of the length of the trench.

Each aperture constitutes the open outlet end of a main bore extending through the plate 80 and having a T-junction with a transverse bore in the plate at a locality spaced from the aperture. The arrangement of main bore 98 and transverse bore 100 associated with aperture 92 is shown in FIG. 9; the other two apertures, 94 and 96, have identical bore arrangements. A supply 102 of paint of a first color, including a pump **102*a* and valves 102*b*, is connected to the main bore associated with each of the three apertures, while a supply 104 of paint of a second color, also including a pump and valves, is connected to the transverse bore of each aperture, as represented diagrammatically in FIG. 9**. The main and transverse bores associated with each aperture, together with the paint supplies, cooperatively constitute means for delivering concurrent laminar flows of two liquid coating materials (two colors of paint) to the trench along a common path through that aperture.

Conveniently, for the illustrative example of operation now to be described, the two colors of paint are supplied to the device of FIGS. 8 and 9 at the same, substantially constant pressure, and the relative flows of the two colors at each aperture are determined by fixed orifice size, e.g. by the relative diameters of the main and transverse bores, such that a major flow of the first-color paint and a minor flow of the second-color paint enter the trench at each aperture. Thus, the supply 102 may include a single pump **102*a* but three valves 102*b* (downstream of the pump) for respectively separately controlling supply of the first color paint to the three main bores 98, while the supply 104 likewise includes a single pump 104*a* but three valves 104*b* for respectively separately controlling supply of the second-color paint to the three transverse bores 100. In a simple yet effective mode of operation, to which detailed reference will be made below, the two valves 102*b* and 104*b* associated with each aperture are electrically controlled to cause simultaneous starting or stopping of flow of both colors of paint through that aperture; i.e. the two valves (for any one aperture) cooperatively function in the same manner as the single valve (63, 64 or 65) provided for each aperture in theembodiment of FIGS. 4 and 5**.

When the apparatus of FIGS. 8 and 9 is operated in this mode for performance of the present process, with the strip 70 being continuously longitudinally advanced and the trench 84 being maintained continuously entirely filled with paint delivered at all three of the apertures 92, 94 and 96 (i.e. all of the valves **102*b* and 104*b* being open), the coating layer applied to the strip surface 78 comprises three contiguously adjacent longitudinal portions (positionally indicated by letters a, b, and c in FIG. 8) respectively constituted of paint delivered at the apertures corresponding positionally to those coating portions. Thus, coating portion a is constituted of paint delivered to the trench at aperture 92; coating portion b is constituted of paint delivered at aperture 94; and coating portion c is constituted of paint delivered at aperture 96**. The relative widths of coating portions a, b and c are directly proportional to the relative total flows of paint respectively delivered at the corresponding apertures. This observed result indicates that the paint delivered at each aperture fills only the portion of the length of the trench adjacent that aperture, and does not intermix with the paint being delivered to an adjacent portion of the trench through an adjacent aperture, notwithstanding that the trench is continuous and undivided along its length. Given the conditions described above, viz. that all the valves are open and that the paint of both colors is supplied at the same pressure to all apertures, the paint delivered at each aperture fills one third of the trench and the coating portions a, b and c are equal to each other in width.

Within the portion of the paint layer corresponding to each aperture, there is produced a pattern of multiple longitudinal striations of the two colors of paint delivered to the trench at that aperture in concurrent laminar flows. Thus, from the three apertures of FIG. 8 there are produced three parallel patterns of longitudinal striations each corresponding to the single pattern produced from the single aperture of FIGS. 1–3. It is believed that within the portion of the trench supplied through each aperture, there is established an essentially separate helical flow pattern of the type shown in FIG. 2, so that there are three such patterns, arranged side by side along a common axis, respectively located adjacent the three apertures in the trench of FIG. 8.

When delivery of paint through any one of the apertures is interrupted by operation of its associated valves, the supply of paint already delivered to the trench through that aperture is progressively depleted by deposit on the advancing strip surface, and occupies a progressively shorter portion of the trench (measured along the trench length); accordingly, the coating portion a, b or c produced by deposit of paint from that aperture becomes progressively narrower along the length of the strip. At the same time, paint continuing to be delivered through one or both of the other apertures progressively occupies a greater portion of the trench length (so that the trench continues to be entirely filled with paint), and in consequence, the coating portion or portions produced by deposit of paint from such other aperture or apertures will exhibit progressive widening along the length of the strip in correspondence with the narrowing of the first-mentioned coating portion. Thus, by alternate and sequential shutoff and resumption of paint flow through the three apertures, there is achieved alternate widening and narrowing of the three coating portions a, b and c along the strip length, while the overall width of the coating remains constant.

As any one of the coating portions a, b and c becomes wider or narrower, the striations contained therein are progressively displaced transversely of the strip, so that (as indicated at 42*a* in FIG. 8) they appear to extend diagonally rather than parallel to the long edges of the strip, although (as further indicated at 42*a*) typically each such diagonal striation is constituted of a staggered array of short parallel striations; as at present believed, this progressive transverse displacement of the striations in the produced coating is a result of progressive axial expansion or compression of the helical flows within the trench incident to the described selective shutoff and resumption of paint supply through the several apertures. In addition to the change in orientation of the striations, the widening or narrowing of the coating portions produces progressive variation in the spacing between adjacent striations and in the degree of blending of the two colors of paint (with consequent variation in apparent width of the striations), all in conformity with the appearance of natural wood grain. Thereby, highly effective simulation of wood grain can be achieved in the produced pattern, i.e. by the simple expedient of alternately closing and opening the sets of valves (102*b* and 104*b*) respectively associated with the three apertures 92, 94 and 96. These results are attained without physical movement of the apertures along the trench, and with a number of apertures that is small in relation to the number of grain lines produced, since each aperture produces a substantial plurality of striations.

A further advantage of the present process, as distinguished from the prior practice of applying a wood-grain-simulating overprint on a pre-applied ground color, is that the striations extend through the coating thickness and are not vulnerable to premature disappearance upon weathering. Another advantage is that the produced pattern, like natural wood grain, can readily be made apparently random (non-repetitive) over any desired length, by appropriately varying the sequence and duration of valve-open and valve-closed conditions for the apertures, whereas an overprinted pattern typically has a short repeat length; yet a particular pattern can be reproduced by reproducing the same sequence of valve operations.

Very conveniently, the valves can be controlled automatically (e.g. by electronic or like means) in accordance with a pre-established sequence. An example of such a sequence is illustrated graphically in FIG. 10, wherein the three vertical axes 92*a*, 94*a* and 96*a* respectively represent apertures 92, 94 and 96 and the vertical distances marked by the horizontal rulings (read downwardly from the top) represent "counts" or equal intervals of time. The shaded blocks extending from each vertical axis indicate those intervals during which the valves for the aperture corresponding to that axis are open. It will be noted that in the particular sequence illustrated, paint flows through only one aperture at a time, and the duration of valve-open periods varies. Since the paint is delivered under pressure, and since the paint supply delivered to the trench through a particular aperture is not immediately exhausted upon closure of that aperture but undergoes progressive depletion, a single open aperture is sufficient to maintain the trench entirely filled with paint, although at various times in an operating sequence (not represented in FIG. 10) paint may be simultaneously delivered through two or even all three apertures. Often, after an aperture is closed, it will be reopened before its previously-delivered paint supplly is entirely depleted; the corresponding coating portion is thus continuous along the length of the strip, first narrowing and then widening again. In other cases, an aperture may be closed for a time such that its previously-depleted paint supply is wholly exhausted, with the result that the associated coating portion becomes discontinuous.

As will be understood from the foregoing description, reference herein to variation in relative flow through the different apertures embraces the simple on-off valve operation wherein flow of paint through each aperture is alternately completely interrupted and fully resumed. More complex modes of relative flow variation, such as variation in relative supply pressures (between the two colors of paint supplied to one aperture, or between the respective paint supplies to different apertures), and valve operation to interrupt supply of only one of the two colors of paint to a given aperture, can also or alternatively be employed. In addition, more than two colors, and two or more than three apertures, can be used.

The plate 80 is provided with lateral projections 106 to facilitate mounting of the plate on appropriate support structure for holding the plate fixed in relation to the axis of the roll 72. The mounting for the plate may include means (not shown) for adjusting the spaced position of the plate relative to the roll axis, thereby to vary the gap defined between the roll surface and the plate surface 82, as may be desired to accommodate strip of different gauges and/or to change the wet thickness of the applied coating layer.

Figure 11:
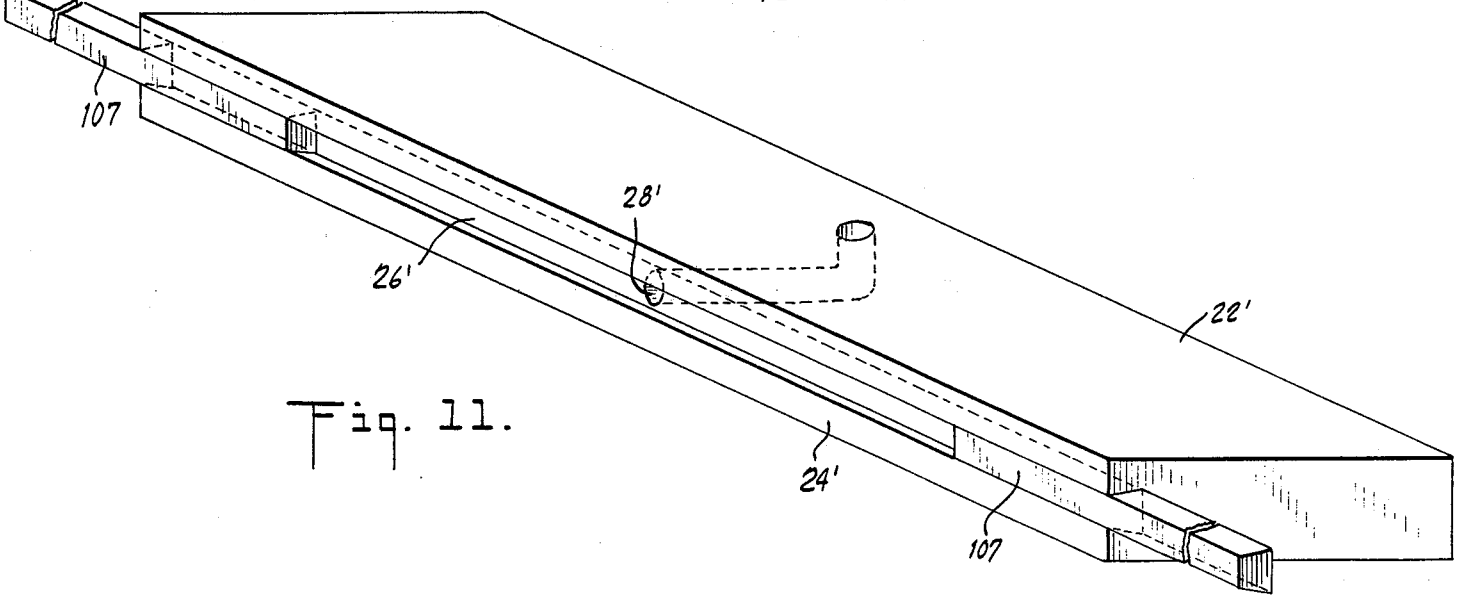
FIG. 11 is a schematic perspective view of a form of trench-defining structure, usable in the practice of the present process, and incorporating means for varying the length of the trench.

Although the plate structures described above (such as the plate 22 in FIGS. 1–3) define trenches having fixed ends, and thus a fixed length, it is advantageous to enable the length of the trench to be adjusted, thereby to vary the width of the applied coating e.g. to facilitate use of the same apparatus to coat strips of different widths. FIG. 11 illustrates schematically a plate 22' having a surface 24' in which is formed an elongated, axially rectilinear trench 26' supplied with paint through an aperture 28', for use in the same manner as the plate 22 of FIGS. 1–3 in applying a coating to a strip article. The trench 26' extends for the full length of the plate, opening through the opposite sides thereof, and is closed at its ends by a pair of shutter members which are snugly but slidably inserted into the opposed extremities of the trench. Means (e.g. clamps, not shown, secured to the plate 22' and adjustably engaging the shutter members) may be provided for holding the shutter members in any desired position. The length of the trench, and consequently the width of the applied coating, can be varied as desired by moving the shutter members longitudinally toward or away from each other within the trench. Thus, for example, in the coating of metal strip for use in making siding panels, the coating layer width can readily be selected to be somewhat less than the strip width, so that both longitudinal edge portions of the coated strip surface are left bare to permit direct metal-to-metal contact between adjacent courses of panels (i.e. when the panels are formed, cut, and installed on a building wall) as is desired to render the panel assembly electrically conductive.

Figure 12:
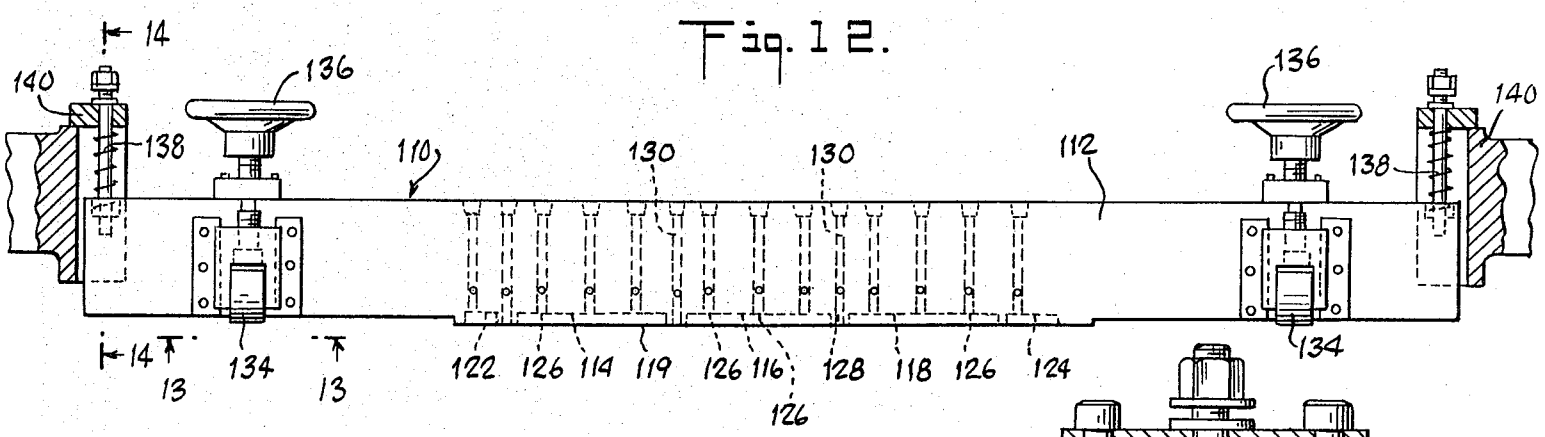
FIG. 12 is a top plan view of the trench-defining structure and associated elements of apparatus representing another embodiment of the invention.
Figure 14:
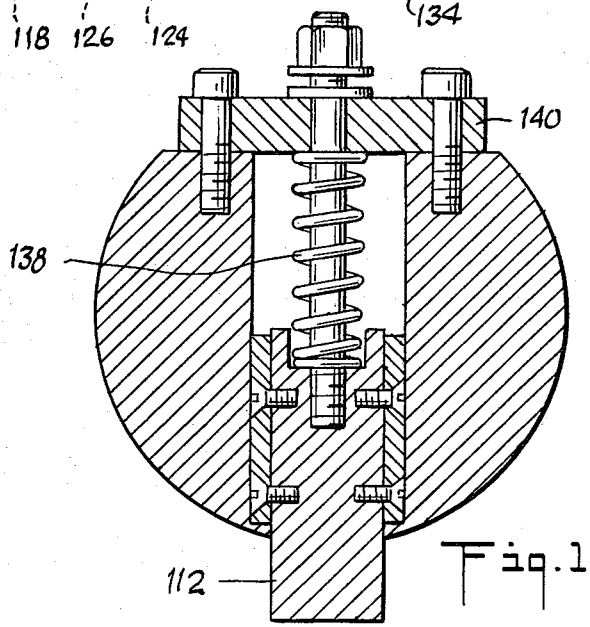
FIG. 14 is an enlarged sectional view taken along the line 14—14 of FIG. 12.
Figure 13:
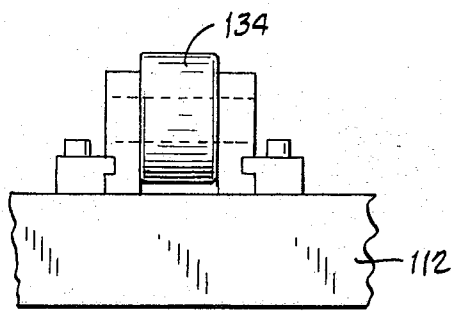
FIG. 13 is an enlarged detail view taken along the line 13—13 of FIG. 12.

FIGS. 12–14 illustrate a further embodiment of the invention, for use in the production of a siding panel that is formed and coated to simulate the appearance of a plurality of wooden siding boards each extending over the length of the panel and separated from each other by longitudinal gaps. Suchd a panel is produced from aluminum strip (typically, strip that is substantially wider than that used to produce an ordinary horizontal clapboard-type siding panel) by first coating the strip surface with a layer of paint having adjacent longitudinal portions respectively simulating boards and gaps between boards, then forming the strip to provide longitudinal indentations or channels at the prepainted locations of the spaces between boards, and finally, cutting the formed strip into desired panel lengths.

The coating device 110 shown in FIG. 12 includes a plate 112 having three trenches 114, 116 and 118 opening through its surface 119. Each of these trenches is horizontally elongated, axially rectilinear, and has an open long side for facing a backup roll (not shown), the three trenches being arranged end to end along a common axis extending perpendicular to the direction of advance of the strip to be coated. Additional short trenches 122 and 124 are provided at the opposite ends of the array of three long trenches 114, 116 and 118. As in the case of the above-described embodiments of the invention, the strip (not shown) to be coated is advanced continuously longitudinally around a backup roll past the plate 112, with its outwardly facing major surface maintained in proximate facing relation to the open long sides of the trenches so as to constitute a moving wall closing the long sides of the trenches. To each of the trenches 114, 116 and 118, paint of two colors is delivered in concurrent laminar flows along a common path at each of three apertures 126, to maintain the trench entirely filled with the paint and to deposit, on the surface portion of the strip that is in register with that trench, a longitudinally striated paint layer.

Each of the trenches 114, 116 and 118, with its associated array of apertures 126 spaced along its length (each having means, not shown, for delivering two colors of paint in concurrent laminar flows), is essentially identical in structure and function to the plate 80 of the apparatus of FIGS. 8 and 9, and is operable to produce a coating band, on the strip surface portion passing the trench, that simulates the wood grain appearance of a board.

The trenches 114, 116 and 118 are separated by portions 128 of the plate that project toward the strip surface. Each of these portions 128 is located at the open outlet end of a bore 130, formed in the plate, through which paint of a dark color is delivered under pressure to the strip surface to form a narrow dark longitudinal band thereon intermediate adjacent board-simulating portions of the coating deposited from the trenches 114, 116 and 118. The end trenches 122 and 124 also have associated bores to which paint may be supplied, if desired, to coat the longitudinal margins of the strip surface. As will be understood, when the strip is formed after coating, the aforementioned longitudinal channels between adjacent "boards" are located in register with the dark bands produced by paint delivered at the plate portions 128.

FIGS. 12–14 further illustrate one exemplary form of means for mounting the plate 112 so as to enable variation in plate position relative to a back-up roll. Specifically, this means includes bearings 134 mounted on and projecting beyond the plate for engaging adjacent support structure, with manually operable threaded elements 136 for varying the extent to which they project beyond the plate, e.g. to space the plate from the support structure against the force of biasing springs 138 (acting between the plate and fixed supports 140) which urge the plate toward a back-up roll.

In addition to providing a pattern (e.g. simulating wood grain) of superior appearance, controllability, and durability, the above-described coating systems and procedures afford other important advantages, with respect to operating economy and efficiency and environmental considerations, as compared to conventional roll-coating systems. The mechanical simplicity of the present systems, which have no coating rolls to maintain, reduces capital investment and maintenance costs as well as saving the energy required to rotate coating rolls. Since the systems are fully enclosed, i.e. applying a coating directly from an enclosed trench to which the paint is supplied under pressure, there is no exposed or visible paint (in open reservoirs or on rolls); hence contamination with dirt is minimized, and splashing or dripping of paint is avoided, so that the operation is advantageously clean and waste of paint is minimized. For the same reason, coatings have a high solids content (and a correspondingly low solvent content) can be applied at high line speeds, whereas with conventional rollers centrifugal effects restrict the speeds at which high-solids coatings can be applied. Such rapid application of high-solids coatings and reduced use of solvents is both economically and environmentally beneficial. Coating color changes can be effected much more rapidly, and with production of much less scrap (strip that passes the coating station and is not satisfactorily coated during a color change), than in the case of roll coating operations, which require relatively lengthy cleanup and reset times for color changes. Thus, the present systems facilitate production of special color coatings in short runs.

Moreover, the present systems achieve smoother, finer-textured coatings than are produced by roll coating, owing in particular (as at present believed) to the extended surface or land which the coated strip passes immediately beyond the trench. Problems of blistering due to air entrapment, a cause of much poor or unsatisfactory coating in conventional operations, are eliminated by the long land and by the application of the coating material under pressure in a fully filled and enclosed trench. A still further advantage is that (as already mentioned) the width of the applied coating can be made narrower than the strip; and there is no build-up of a relatively thick bead of coating material along the edges of the coated strip, as occurs in conventional roll coating. Since the bead, if present, interferes with proper recoiling of the coated strip unless special measures (e.g. involving periodic axial movement of the recoil drum) are taken to accommodate it, the avoidance of bead formation is especially desirable.

It is to be understood that the invention is not limited to the features and embodiments hereinabove specifically set forth but may be carried out in other ways without departure from its spirit.

We claim:

1. A process for producing a longitudinally striated coating on a major surface of an elongated strip article, comprising (a) continuously advancing the article lengthwise past an open long side of an otherwise enclosed elongated trench extending transversely of the article with said major article surface disposed in facing proximate relation to said open trench side to constitute a moving wall closing said open side, while (b) continuously delivering at least two liquid coating materials to the trench under pressure for providing concurrent laminar flows of the two materials in contact with each other along a common path, at least at one locality in a long side of the trench, such that both materials flow within the trench from said one locality in at least one common direction lengthwise of the trench, and for maintaining the trench continuously entirely filled with the liquid coating materials, thereby to deposit a continuous coating layer on said major surface through said open side, said two liquid coating materials being circulated within the trench by motion of said major surface so as to be distributed in said coating layer in alternating longitudinal striations.

2. A process according to claim 1, wherein the striations of the two coating materials differ visibly from each other in appearance.

3. A process according to claim 2, wherein the two coating materials differ from each other in pigmentation.

4. A process according to claim 1, wherein the delivering step comprises delivering the two liquid coating materials to the trench in concurrent laminar flows along a common path, at least at one locality in a long side of the trench spaced from said open side.

5. A process according to claim 1, wherein the delivering step comprises delivering concurrent laminar flows of at least two liquid coating materials to the trench under pressure along common paths at least at two localities, spaced apart along the length of the trench in a long side of the trench and spaced from said open side, such that adjacent longitudinal portions of said coating layer are respectively constituted of coating materials delivered at said two localities, each of said portions comprising alternating striations of said two coating materials.

6. A process according to claim 5, including the step of varying the relative total flows of coating materials respectively delivered at said two localities during the course of coating said major surface so as to vary the relative widths of said adjacent longitudinal portions of said coating layer.

7. A process according to claim 6, wherein the varying step comprises alternately starting and shutting off the total flows respectively delivered at said localities.

8. A process according to claim 1, including the step of advancing the strip article, immediately beyond said open side of said trench, past an extended surface facing the coating major surface of the article and fixed in relation to the trench, while maintaining the extended surface and the article major surface uniformly spaced apart by a distance equal to a predetermined desired thickness of said coating layer.

9. A process according to claim 1, wherein the strip article advancing step comprises advancing the article around a roll disposed in proximate relation to the open side of the trench.

10. A process according to claim 1, wherein said strip article is advanced in a direction parallel to its long dimension and perpendicular to the long dimensions of the trench and the open side thereof.

11. A process according to claim 1, including the step of varying the relative flows of said two liquid coating materials delivered to the trench for providing concurrent laminar flows at said one locality.

12. A process according to claim 6, wherein the number of said spaced localities is at least three.

13. A process for producing a striated coating on an extended solid surface, comprising (a) establishing and maintaining, in a confined chamber partially enclosed by a portion of the surface to be coated, concurrent, coaxial laminar helical flows of at least two liquid coating materials, the chamber being entirely filled with the liquid coating materials, while (b) continuously effecting relative movement of said surface and said chamber, in a direction transverse to the axis of said helical flows, for depositing on the surface a coating layer having alternating striations of said two coating materials extending in said direction.

* * * * *